US005186649A

United States Patent [19]

Fortner et al.

[11] Patent Number: 5,186,649

[45] Date of Patent: Feb. 16, 1993

[54] MODULAR PLUG HAVING ENHANCED CORDAGE STRAIN RELIEF PROVISIONS

[75] Inventors: Larry E. Fortner, Indianapolis, Ind.; Paul R. Gustin, Glendale, Ariz.; Leonard F. Hasler, Indianapolis, Ind.; Harold E. Johnson, Phoenix, Ariz.; George R. Maul, Glendale, Ariz.; David L. Reed, New Palestine, Ind.; George W. Reichard, Jr., Carmel, Ind.

[73] Assignee: AT&T Bell Laboratories, Murray Hill, N.J.

[21] Appl. No.: 876,340

[22] Filed: Apr. 30, 1992

[51] Int. Cl.[5] ..... H01R 13/58

[52] U.S. Cl. ..... 439/460; 439/676

[58] Field of Search ..... 439/456, 457, 460, 676

[56] References Cited

U.S. PATENT DOCUMENTS

| | | | |
|---|---|---|---|
| 3,860,316 | 1/1975 | Hardesty et al. | 339/91 R |
| 3,990,764 | 11/1976 | Kumreich | 339/176 M |
| 3,998,514 | 12/1976 | Hardesty et al. | 339/99 R |
| 4,002,392 | 1/1977 | Hardesty | 339/99 R |
| 4,090,763 | 5/1978 | Congdon et al. | 339/103 M |
| 4,148,539 | 4/1979 | Hardesty | 339/99 R |
| 4,160,575 | 7/1979 | Schraut | 439/460 |
| 4,607,905 | 8/1986 | Vaden | 439/676 |
| 4,950,176 | 8/1990 | Cocco et al. | 439/344 |

*Primary Examiner*—Eugene F. Desmond
*Attorney, Agent, or Firm*—E. W. Somers; D. E. Hayes

[57] ABSTRACT

A modular plug (23) for terminating cordage includes a housing (41) having a free end (46) and a cordage-input end. An end portion of a length of cordage (21) to be terminated by the plug is inserted into the cordage-input end of the housing to cause exposed individually insulated conductors extending beyond a jacketed portion of the cordage to be received in a conductor-holding portion of the housing. Blade-like terminals (42—42) inserted into slots opening to an exterior surface of the housing engage electrically the conductors. An anchoring member (61) is caused to be moved to an operative position whereat a primary jacket anchoring surface (74) of the anchoring member becomes disposed in compressive engagement with a jacket of the cordage. The geometry of the anchoring member is such that the primary anchoring surface in an unoperated position is angled to a longitudinal axis of the end portion of the length of cordage. Also, the jacket anchoring surface has suitable length so that when in an operated position in which the jacket anchoring surface is substantially parallel to the longitudinal axis of the end portion of the length of cordage, relative motion between the housing and portions of the cordage outside the housing do not induce undue stress concentrations in the cordage. The anchoring member secures the end portion of the cordage against unintended movement with respect to the housing and transfers forces applied to the cordage to the housing. Strain-relief facilities also are provided for the insulated conductors and are such that a conductor restraining bar (75) under the application of forces is moved substantially linearly into engagement with the conductors.

21 Claims, 3 Drawing Sheets

MODULAR PLUG HAVING ENHANCED CORDAGE STRAIN RELIEF PROVISIONS

TECHNICAL FIELD

This invention relates to a modular plug having enhanced cordage strain relief provisions. More particularly, this invention relates to a modular plug for terminating cordage used for communications, the plug including provisions for enhanced engagement with an outer jacket of an end portion of a length of cordage to secure the plug to the cordage and provide enhanced strain relief therefor.

BACKGROUND OF THE INVENTION

In the telephone industry, modular plug type connectors are used on retractile and straight cords which are used between the base and a handset of a telephone and between the base and a wall terminal block. See, for example, U.S. Pat. No. 4,148,539 which issued Apr. 10, 1979, in the name of E. C. Hardesty.

In a modular plug, tinsel, stranded or solid conductors are confined in conductor-receiving troughs formed in a dielectric housing. Flat, blade-like metallic terminals are then inserted into individual slots in the housing in a side-by-side arrangement with contact portions thereof extending into engagement with the conductors. When the plug is inserted into a jack of a telephone handset or base or wall terminal block, portions of terminals in the jack engage portions of associated terminals in the plug.

Care must be taken so that when pulling forces are applied to cordage which is terminated by a modular plug, the forces do not appear at the connections between the conductors of the cordage and the metallic blade-like terminals. Otherwise, the electrical connections between the conductors and the terminals may be compromised. In other words, the plug must include provisions other than the electrical connections for securing the plug to the end portion of the length of cordage.

A modular plug which includes strain relief facilities which divert forces from the cordage-terminal connection points to the housing is known in the prior art. See U.S. Pat No. 3,998,514 which issued on Dec. 21, 1976, in the name of E. C. Hardesty. An anchoring member is provided in an opening of the housing and is connected to the housing through a plastic hinge oriented toward a free end of the modular plug. The anchoring member also is connected to the housing of the plug toward a cordage-input end of the housing by a frangible portion of dielectric material. The frangible portion supports the anchoring member in its initial position to facilitate insertion of an end portion of a length of cordage into the housing. Forces are applied to the anchoring member to actuate it and cause it to be moved pivotally into clamping engagement with the end portion of the cordage. The pivotal movement of the anchoring member causes originally external facing portions to be moved along the side of a wall which defines partially the opening and then to latch under a lip formed by a portion of the surface of the housing. Portions of the anchoring member and a surface which defines the opening and a surface adjacent thereto cooperate to positively hold the anchoring member in engagement with the housing and the cordage when retrograde forces are applied to the cord by the customer during use.

A problem that has surfaced relates to the engagement of the anchoring member with the jacket of the cordage. The frangible portion of the anchoring member of presently used plugs becomes embedded in the jacket of the cordage terminated by the plug. Over time, the jacket plastic flows and the degree of engagement of the anchoring member with the jacket may decrease, thereby causing some of the strain due to pulling forces applied to the cordage to be transferred to the electrical connections. Further, the embedment of the frangible portion and the geometry of the anchoring member may cause one or ones of the conductors to be broken.

Also, the problem of reduced effectiveness of the strain relief member may be exacerbated because of the number and frequency of occurrences of use of a telephone handset, for example, to which such a plug-terminated cord is connected. Such usage may decrease the time during which the flow of the plastic material occurs to the point of resulting in unacceptable loss in strain relief.

In the past, the anchoring member has been formed such that a portion of the anchoring member including the frangible portion forms a somewhat rounded trailing edge as the frangible portion is broken to allow pivotal movement of the anchoring member to engage the jacketed end portion of the cordage. Because this is the portion that is most deeply embedded into the cordage, it is most advantageous that there be no sharp burrs or edges opposed to the direction of pulling forces to tear the material comprising the jacket during customer use. Nevertheless, it has been found that because of the frequency of usage there still occurs a problem because of the nature of the embedment of the anchoring member in the cordage jacket.

Also, a modular plug of the prior art includes a conductor-restraining bar. The conductor-restraining bar is disposed in another opening which communicates with the terminal-receiving side of the housing and is supported therein by two unequal height webs of plastic material. When forces are applied, the bar separates from the housing along the webs and tends to move pivotally to engage the conductors. Such an arrangement for restraining the conductors may allow some relative movement between the conductors and the terminals and/or may result in damage to the conductors.

What is needed and seemingly what is not provided in the prior art is a modular plug having enhanced jacket and conductor strain relief provisions. Such sought after strain relief provisions must be capable of being included in the plug without having to change its present overall geometry.

SUMMARY OF THE INVENTION

The foregoing problems of the prior art have been overcome by the modular plug of this invention. A modular plug which is used to terminate an end portion of a length of cordage which is capable of carrying electrical signals comprises a housing which is made of a dielectric material, which includes a cavity for receiving an end portion of a jacketed length of cordage that is capable of carrying electrical signals and a portion which communicates with the cavity and which receives conductors extending from the jacketed end portion. Included are a plurality of slots each adapted to receive a terminal that engages an aligned conductor of the end portion of the cordage. Each of a plurality of blade-like terminals is received in one of the slots and engages an aligned conductor of the end portion of the cordage, and has a portion exposed to an exterior of the housing for engaging an exterior component.

A jacket anchoring member is disposed in an opening of the housing and is capable of being moved pivotally from an initial position to an operated position wherein it engages the jacketed end portion of the cordage to hold the cordage in secured engagement with the housing. The anchoring member is supported in an unoperated position by side tabs which do not become embedded in the cordage jacket when the anchoring member is moved to an operated position. The jacket anchoring member includes an engaging, anchoring surface which in an unoperated position is angled to a longitudinal axis of the end portion of the cordage and which in an operated position is substantially parallel to the longitudinal axis of the end portion of the length of cordage. The anchoring surface has sufficient length so that when relative motion between the housing and portions of the cordage adjacent to the end portion of the cordage is caused to occur, undue stress concentrations in the cordage are inhibited. The anchoring member is configured to avoid the embedment in the jacket of the cordage of intersections of surfaces of said anchoring member which are detrimental to the reliable operation of the cordage over a relatively long period of time.

Further, the plug housing includes a conductor restraining bar which has a trapezoidal configuration. The geometry of the conductor restraining bar and an arrangement for supporting it in an unoperated position cause it to be moved, under the application of forces, in a substantially linear path into clamped engagement with the cordage conductors. This arrangement precludes relative movement between the conductors and the terminals.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
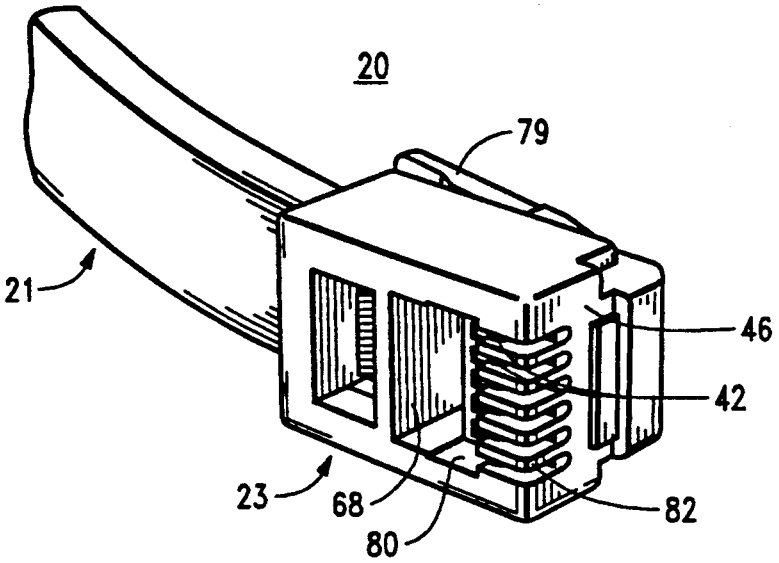
FIG. 1 is a perspective view of a modular plug which includes enhanced strain relief provisions.
Figure 2:
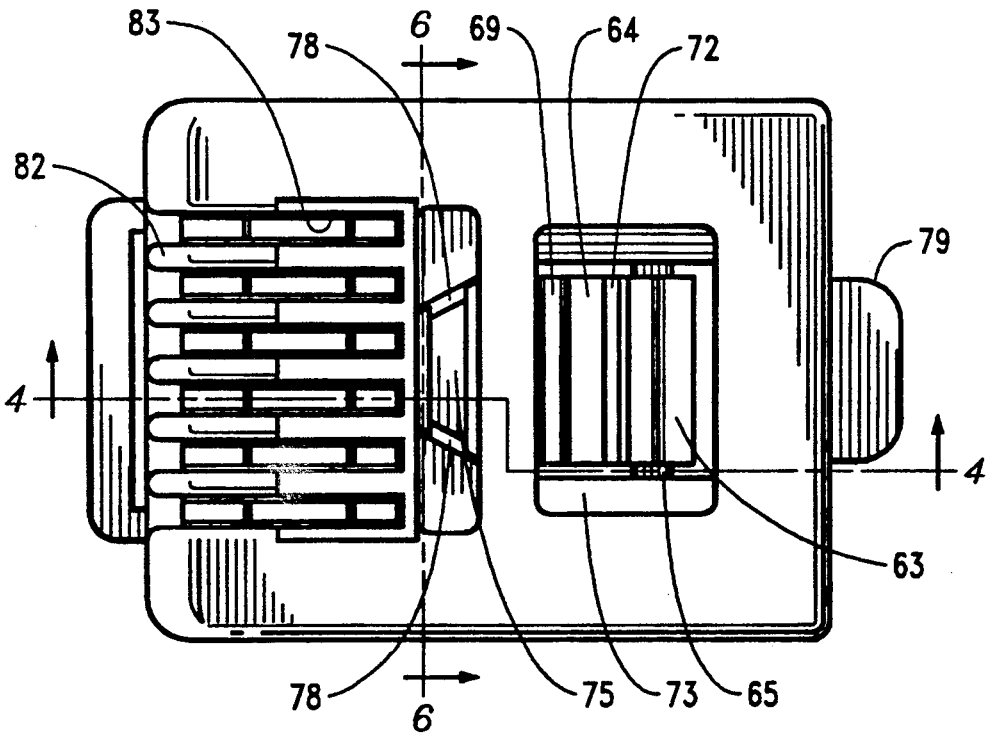
FIG. 2 is a top plan view of the plug of FIG. 1.

Modular cord systems typically include cords 20—20 (see FIG. 1), each comprising a length of cordage 21 terminated at each end by a modular plug 23 (see also FIG. 2). The cordage 21 includes a plurality of individually insulated flexible conductors 22—22 (see FIG. 3). The cords are terminated with modular plugs 23—23 of the type shown, for example, in priorly mentioned U.S. Pat. No. 4,148,539 which is incorporated by reference hereinto.

The construction of the cordage 21 is well known. The flexible conductor 22 may be solid wire, stranded wire or a filamentary core having a plurality of tinsel ribbons wrapped helically thereabout and enclosed with a suitable insulative covering such as that, for example, disclosed and claimed in U.S. Pat. No. 4,090,763. The insulated conductors 22—22 (see FIG. 3) may be disposed side-by-side in a planar array and are enclosed in a common jacket 34 made of a suitable plastic material. The final cord configuration has a cross-section with parallel sides and semi-circular ends and is referred to as a flat cord. Also, the insulated conductors may be disposed in a non-planar configuration such that the transverse cross section of the cordage is circular.

Figure 3:
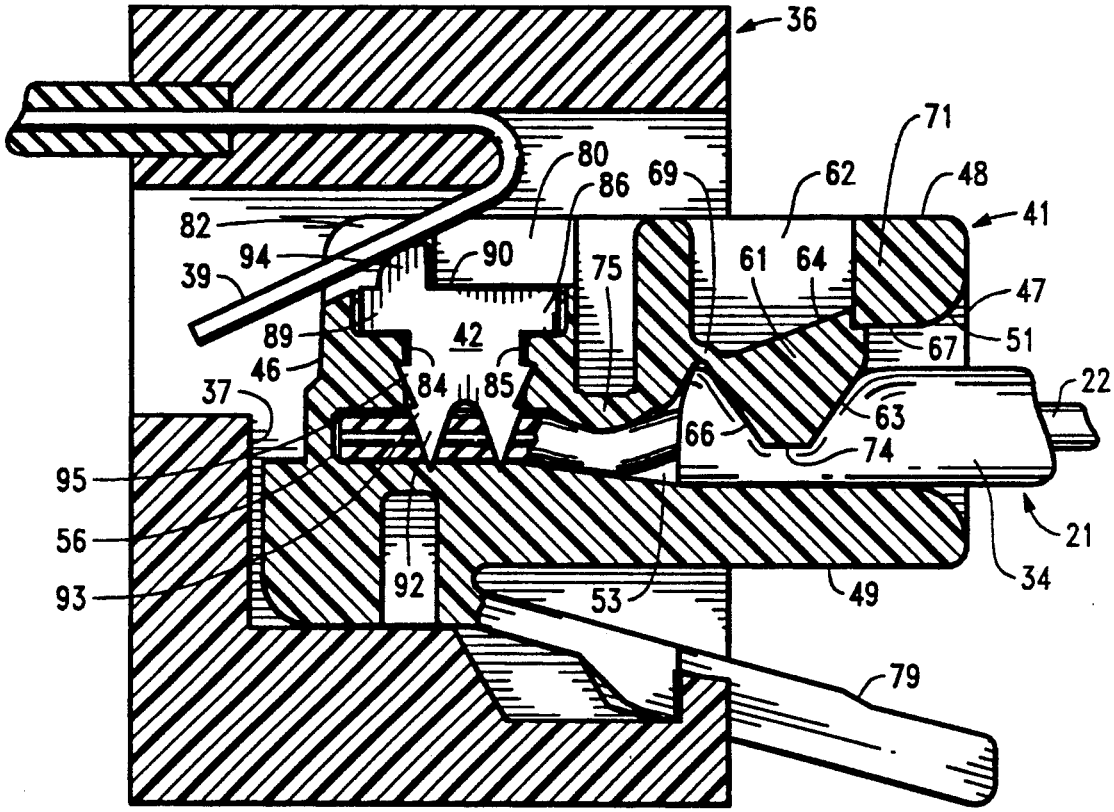
FIG. 3 is a side elevational view in section of the modular plug of FIG. 1 showing an end portion of a length of cordage terminated by the modular plug of FIG. 1 and showing the plug inserted into a jack.

The cord 20 is connected to a telephone hand set, to a telephone base, or to a wall terminal by inserting a plug 23 into a jack 36 (see FIG. 3). The jack 36 is typically that shown in U.S. Pat. No. 3,990,764 which issued Nov. 9, 1976 in the name of C. L. Krumreich and which is incorporated by reference hereinto. The jack 36 includes a cavity 37 and a plurality of wire-like contact elements 39—39 which are spaced on 0.10 cm centers and which protrude angularly into the cavity of the jack in which is received the modular plug.

As can be seen in FIGS. 1 and 3, the modular plug 23 constructed in accordance with the principles of this invention includes a housing 41, which is made from a dielectric material, and a plurality of terminals 42—42. The terminals 42—42 are destined to connect electrically the conductors 22—22 of the cord which are housed within the plug 23 and electrical components of telephone apparatus such as, for example, the wire-like contact elements 39—39 of the jack 36. The terminals 42—42 are mounted within the housing 41 to be engagable by the contact wires 39—39 in the jack 36.

The plug housing 41 is a unipartite rigid housing (see FIGS. 1-3) made from a plastic material such as polycarbonate. The housing 41 includes a so-called free or termination end 46 which is closed. Further, the housing 41 includes a cordage-input end 47, a terminal-receiving side 48 and a side 49 opposite the terminal-receiving side. As may be observed from the drawings, the cordage-input end 47 of the housing 41 is formed with a flared cord input aperture 51 designed to circumscribe generally the outer periphery of the largest cordage expected to be terminated with the plug 23. The aperture 51 opens to a cavity 53 which includes a plurality of conductor-receiving troughs 56—56 disposed in a conductor-receiving chamber 55 (see FIG. 4).

The conductor-receiving troughs 56—56 are constructed to provide a plurality of individual duct-like compartments which are disposed in one tier for receiving the conductors of a cordage 21. They extend longitudinally from the vicinity of the free end 46. Each of the compartments is of sufficient size to accept one of the conductors of the cordage 21.

Figure 4:
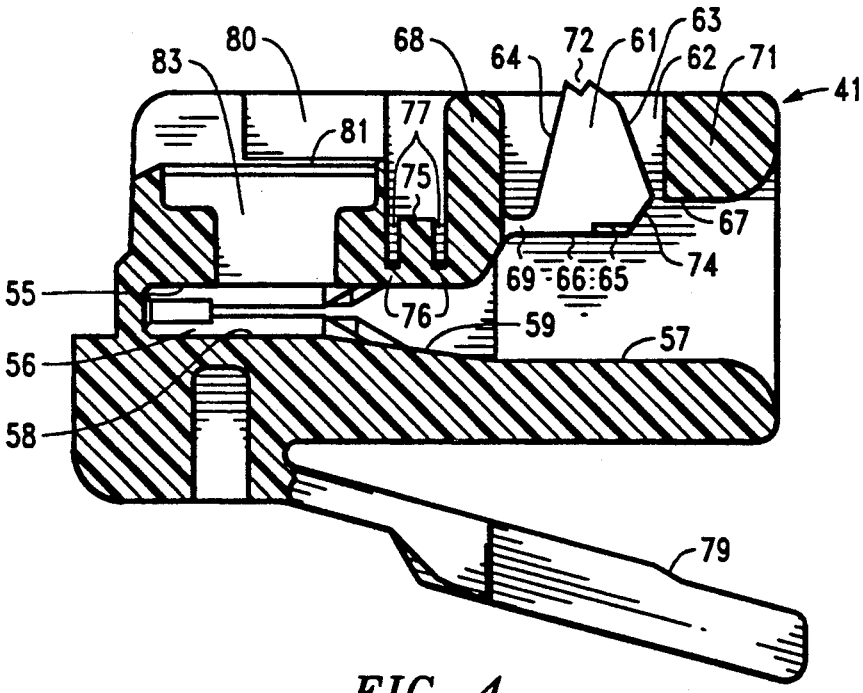
FIG. 4 is a side elevational view of a portion of the modular plug of FIG. 3 showing strain relief provisions for a jacket of the cordage in an unoperated position.

It should be observed from FIG. 4 that the cavity 53 is defined partially by a floor surface 57 whereas the conductor-receiving chamber is defined partially by a floor surface 58. The floor surfaces 57 and 58 are joined by an inclined floor surface 59 which in a direction from the cordage-input end to the free end of a housing slopes toward the terminal-receiving side of the housing. As a result, the cavity 53 is enlarged to facilitate the disposition of the anchoring member 61 in the operative position shown in FIG. 4.

An assembler removes a sufficient length of the cordage jacket 34 to permit insertion of the conductors into the troughs 56—56. Then the assembler installs the jacketed portion of the cordage 21 into the aperture 51 with the conductors extending farther along into the troughs 56—56.

The modular plug 23 also is provided with jacket strain relief facilities. See U.S. Pat. No. 4,002,392 which issued on Jan. 11, 1977 in the name of E. C. Hardesty. A jacket anchoring member 61 (see FIG. 4) is disposed within an opening 62 which opens to the terminal-receiving side of the housing and includes surfaces 63 and 64. The anchoring member 61 is connected to a portion 68 of the housing through a plastic hinge 69 which is oriented toward the free end 46 of the housing 41. At its other end, the anchoring member is supported in a temporary position by side tabs 65—65 (see FIGS. 2 and 4) connected to sidewalls 73—73. The side tabs 65—65 support the anchoring member 62 in the as-manufactured, unoperated position to permit insertion of the end portion of the cordage 21 into the cavity 53.

The side tabs 65—65 support the anchoring member 61 in its initial position to facilitate insertion of an end portion of cordage 21 into the cavity 53. As can best be seen in FIGS. 2 and 4, each side tab 65 is constructed such that its thickness as measured in a vertical direction in FIG. 4 adjacent the sidewalls 73—73 is substantially less than that of the hinge adjacent the wall 68. This facilitates the separation of the member 61 from the sidewalls 73—73 to be adjacent the cordage-input end so that the anchoring member may be moved pivotally about the hinge 69 to engage the jacket of the end portion of the length of cordage.

The anchoring member 61 includes a surface 66 which when the anchoring member is in an unoperated position protrudes slightly into the cavity 53 beyond an adjacent surface 67 of the remainder of the housing adjacent the cordage-input aperture 51.

The externally facing surfaces of the anchoring member 61 have a step 72 formed therebetween (see FIG. 4). The pivotal movement of the anchoring member 61 causes the originally external facing portion 63 to be moved forcefully along the side of a wall 71 which defines partially the opening 62 and then to latch a minimum distance under a lip formed by a portion of the surface 67 (see FIG. 3). There is some compression of the externally facing portion during this movement, but once it is moved out of engagement with the side wall of the opening 62, its elastic memory properties facilitate a springback to its initial configuration with an accompanying latching of the step under the lip surface 67.

The step 72 engages the wall 71 to prevent overtravel of the anchoring member 61 when moved to engage the cordage 21 thereby preventing excessive distortion of the cordage. The step 72 and the lip surface 67 cooperate to positively hold the anchoring member 61 in engagement with the housing 41 and the cordage 21 (see FIG. 3) when retrograde forces are applied to the cord by the customer during use.

The intersection of the surfaces 63 and 66 is formed with a chamfer 74 (see FIGS. 3 and 4) which is a primary jacket anchoring or engaging surface. With the anchoring member in an unoperated position, the chamfer 74 is inclined to a longitudinal axis of the cordage as positioned within the plug housing 41. Also, the surface 66 is substantially parallel to the longitudinal axis of the cordage end portion.

Figure 5:
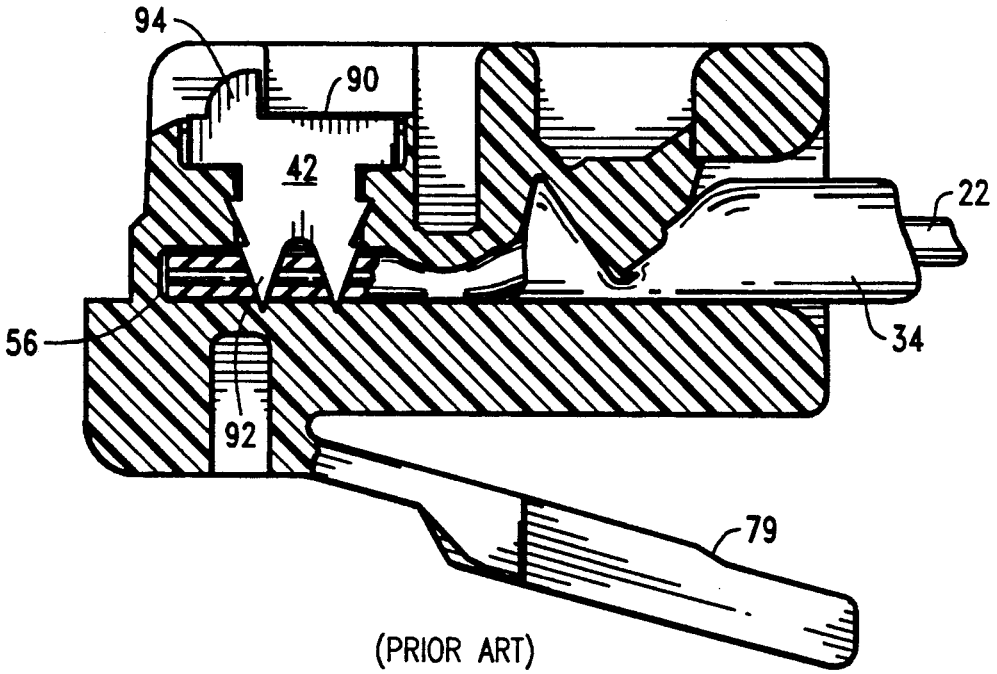
(PRIOR ART) FIG. 5
FIG. 5 is a side elevational view of a prior art modular plug with strain relief provisions thereof being shown in an operative position in secured engagement with an end portion of a length of cordage which has been inserted into a cordage-input end of a housing of the plug.

Advantageously, when forces are applied to the anchoring member 61 and the anchoring member is moved pivotally about the hinge 69 until the step snaps into engagement with the intersecting surfaces of the wall 71, the chamfer 74 engages the cordage 21 and becomes disposed substantially parallel to the longitudinal axis of the end portion of the cordage. Further advantageously, there is no breakaway frangible portion of the anchoring member adjacent to the wall 71. As a result, there is no sharp portion of plastic which becomes embedded in the plastic jacket of the cordage terminated by the plug 23 (see prior art plug in FIG. 5).

After having inserted an end portion of a cordage 21 into the cavity 53, the assembler applies forces to the anchoring member 61 to break the tabs 65—65 and move the anchoring member about its plastic hinge 69. The step 72 formed on the anchoring member 61 cooperates with the wall 71 to maintain the anchoring member in locked engagement with the cordage and the housing.

Advantageously, when the anchoring member 61 is in the operated position, the chamfer 74 is substantially parallel to a longitudinal axis of the cordage thereby avoiding any sharp embedment of portions of the anchoring member with the cord jacket. Further, angles between the surfaces 63 and 66 and the chamfer 74 are generally obtuse, again reducing the severity of the embedment of portions of the anchoring member with the cordage jacket.

The plug 23 also may include a conductor strain relief portion 75 (see FIGS. 2 and 4). A prior art conductor strain relief portion is disclosed in U.S. Pat. Nos. 3,860,316 and 4,002,392, both of which are incorporated by reference hereinto. Therein grooves on each side of a conductor engaging portion are of unequal height so that the portion moved pivotally as forces were applied thereto. It is designed to anchor the conductors in engagement with the bottom of the chamber in order to provide strain relief for the conductors.

Figure 6:
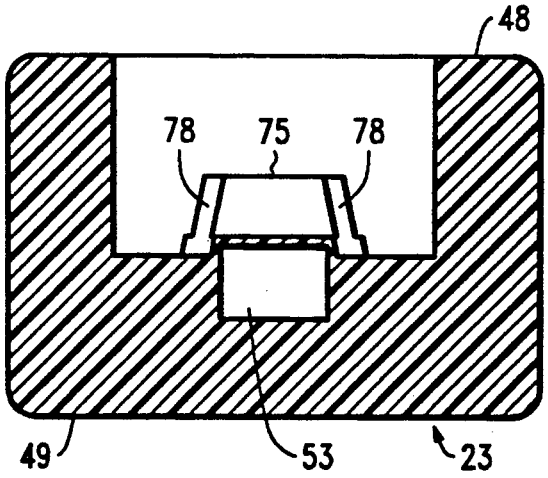
FIG. 6 is an end sectional view of a portion of the plug of FIG. 1 to show strain relief provisions for conductors of the end portion of the cordage terminated by the plug.

In the modular plug of this invention, the conductor strain relief portion 75 (see FIG. 4) is supported in an unoperated position by equal height webs 76—76 thereby providing equal depth grooves 77—77. Further, as can be seen in FIGS. 2 and 6, side surfaces 78—78 of the portion 75 are tapered. It has been found that such geometry causes the portion 75 to be moved generally linearly when forces are applied thereto. This is advantageous when using a stranded as opposed to a tinsel conductor, the stranded conductor being less compressible than the tinsel conductor. Also, the conductor strain relief portion 75 prevents relative movement between the conductors and the terminals.

A depressible tab 79 is provided for locking the plug within a jack with the tab and its operation being disclosed in priorly identified U.S. Pat. No. 4,148,539.

In order to mount a plurality of the terminals 42—42 in the housing 41, the housing is constructed with a well 80 (see FIG. 1) opening to the terminal-receiving side 48 of the plug and having an inner surface 81 (see FIG. 4). The plug 20 of this invention includes a plurality of partitions 82—82 (see FIGS. 1 and 2). In the plug 20, the portion of each partition 82 which extends to and which is coplanar with the terminal-receiving side 48 extends for only of the fraction of the distance between the ends of the well 80 (see FIGS. 1 and 2). When a plug 23 is inserted into a jack 36, each wire-like contact member 39 is received between adjacent ones of the partitions 82—82 adjacent to the free end of the plug or between a partition and a sidewall of the well 80.

Each terminal 42 is adapted to be received in a terminal-receiving slot 83 (see FIGS. 2 and 4). Each of the terminal-receiving slots 83—83 opens to the surface 81 and connects the well 80 with an associated one of the conductor-receiving troughs 56—56. The terminal-receiving slots 83—83 extend parallel to the troughs 56—56 and include end walls 84 and 85. As can be seen on FIG. 2, the end walls 84 and 85 are oriented toward the free end 46 and the cordage-input end 47, respectively, of the housing 41.

Each of the terminals 42—42 is flat and blade-like and is made from a strip of an electrically conductive material such as, for example, brass or Phosphorbronze alloy. As can best be seen in FIG. 3, each terminal 42 includes a body portion 86 defined by flat faces which are spaced apart by end edge surfaces. The end surfaces are interrupted by cutouts to form shoulders 89—89. The terminal has an overall height of about 0.42 cm, an overall length of about 0.34 cm and a thickness of about 0.03 cm.

Internal contact portions in the form of tangs 92—92 extend from a lower portion of the body 86 of the terminal 42. When the terminals 42—42 are seated fully within the housing 41, the tangs 92—92 pierce through the insulation of and engage electrically the conductors 22—22. When the terminal 42 is in the fully seated position, the tangs 92—92 extend through the conductors and become embedded slightly in the bottoms of the conductor-receiving facilities of the housing. This supplements side edge support of the terminals 42—42 in the housing 41 to prevent unintended movement of the terminals.

The terminal 42 also includes two sets of side edge barbs. One set of barbs 93—93 are disposed adjacent to the tangs 92—92 and another set of side barbs 95—95 are disposed between the side barbs 92—92 and shoulders 89—89. As the terminals 42—42 are seated in the housing 41, the barbs 93—93 and the barbs 95—95 dig into the end walls 82 and 83 of the housing 41 to anchor the terminals in the slots 81—81. The plastic housing 41 cooperates with the edge surfaces of the terminal 42 to support the terminals in an inserted position.

Each terminal 42 has an externally facing portion in the form of a reference edge surface 90 (see FIG. 3). The reference edge surface 90 extends from one end edge surface toward the other end edge surface.

In order to engage an external component such as a wire-like contact element 39 of a jack 36 into which the plug is inserted to complete an electrical circuit from the cord to the jack, the terminal includes an external contact portion. In a preferred embodiment, the external contact portion is configured to include an asymmetrically disposed fin-shaped protrusion 94 (see FIG. 3) which extends from the body portion 86 along the exposed reference edge surface 90 of the terminal. The outermost portion of the protrusion 94 is spaced a predetermined distance above the reference surface 90. This insures that it is within a range of distance below the outer edge surfaces of the partitions 82—82 when the tangs 92—92 are embedded in the bottoms of the troughs 56—56.

It is to be understood that the above-described arrangements are simply illustrative of the invention. Other arrangements may be devised by those skilled in the art which will embody the principles of the invention and fall within the spirit and scope thereof.

We claim:

1. A modular plug which is used to terminate an end portion of a length of cordage, said modular plug comprising:

a housing which is made of a dielectric material, which includes a cavity for receiving an end portion of a jacketed length of cordage and a portion that communicates with said cavity and that receives transmission media extending from the jacketed end portion of a length of cordage, which includes a plurality of slots each adapted to receive a terminal that engages an aligned transmission medium of the end portion of the cordage and which includes an opening that is disposed toward a cordage input end thereof;

a plurality of blade-like terminals each received in one of said slots for engaging an aligned transmission medium of the end portion of the cordage, and having a portion exposed to an exterior of said housing for engaging an exterior component; and an anchoring member disposed in said opening of said housing and capable of being moved pivotally from an unoperated position to an operated position wherein it engages the jacketed end portion of the cordage to hold the cordage in secured engagement with said housing, said anchoring member including a jacket-engaging surface which in an unoperated position is angled to a longitudinal axis of the end portion of the cordage and which has suitable length so that when in an operated position in which said jacket-engaging surface is substantially parallel to the longitudinal axis of the end portion of the length of cordage and relative motion between the housing and portions of the cordage adjacent to the end portion of the cordage is caused to occur, undue stress concentrations in the cordage are inhibited.

2. A modular plug which is used to terminate a length of cordage which is capable of carrying electrical signals, said modular plug comprising:

a housing which is made of a dielectric material, which includes a cavity for receiving an end portion of a length of jacketed cordage, which includes a conductor-receiving chamber and which includes a plurality of terminal-receiving slots, each said terminal-receiving slot communicating with said conductor-receiving chamber and with an exterior of said housing, further said housing including an opening that is disposed adjacent to a cordage-input end of said housing and that opens to a terminal-receiving side of said housing;

a plurality of electrically conductive blade-like terminals each of which is disposed in one of said terminal-receiving slots and each of which has an internal contact portion for engaging a conductive portion of a conductor that is disposed in an aligned portion of said conductor-receiving chamber and further which has an external contact portion which is adapted to engage a component external to said modular plug; and a jacket engaging, cordage anchoring member which is disposed within said opening of said housing, said anchoring member having one portion thereof connected to a portion of the housing to permit pivotal movement of said anchoring member when forces are applied thereto at a location adjacent to the cordage-input end of the housing, said anchoring member including two intersecting surfaces which form a step such that when the anchoring member is moved to an operated position in clamped engagement with an end portion of a length of jacketed cordage that has been inserted into said cordage-input end of said housing, one of said intersecting surfaces engages an inwardly facing surface of the cordage-input end of said housing and the other intersecting surface engaging a wall which defines said opening, the dual engagement of the intersecting surfaces with surfaces of the housing being effective to maintain the anchoring member in locked engagement with the cordage notwithstanding the application of retrograde forces to the cordage, said anchoring member also having a jacket-engaging surface which has suitable length so that when said anchoring member is in an unoperated position is angled to a longitudinal axis of the end portion of the cordage and which has suitable length so that when said anchoring member is in an operated position in which the jacket-engaging surface is oriented substantially parallel to the longitudinal axis of the end portion of the cordage in clamped engagement with the end portion of the jacketed length of cordage and relative motion between the housing and portions of the cordage adjacent to the end portion is caused to occur, undue stress concentrations in the cordage are inhibited.

3. The modular plug of claim 2, wherein said anchoring member includes an inner surface which faces into said cavity when said anchoring member is in an unoperated position such that said inner surface is substantially parallel to the longitudinal axis of said plug and said jacket engaging surface is angled to said inner surface.

4. The modular plug of claim 3, wherein angles between said jacket-engaging surface and adjacent surfaces of said jacket anchoring member are obtuse.

5. The modular plug of claim 3, wherein said jacket-engaging surface is a primary jacket anchoring surface and said anchoring member includes a surface which connects said primary jacket-engaging surface to one of said intersecting surfaces, the operation of said anchoring member to cause said intersecting surfaces which form a step to become disposed in locked engagement with said surface of said opening and said surface of said housing causing at least portions of said connecting surface and of said inner surface of said anchoring member and said primary jacket-engaging surface to engage the jacket of an end portion of a jacketed length of cordage which has been inserted into said cavity.

6. The modular plug of claim 3, wherein said anchoring member is supported in an unoperated position by means which do not become embedded in the cordage jacket when said anchoring member is moved to an operated position.

7. The modular plug of claim 6, wherein the pivotally moveable portion of the housing includes an anchoring member connected at one end through a hinged portion oriented toward a free end of the housing and the other end of the anchoring member oriented toward the cordage-input end of the housing, said anchoring member being held in the unoperated position by side tabs disposed along at least one axis which is normal to an axis of said plug which extends from said free end to said cordage-input end of said housing so that the application of forces for moving the anchoring member from the unoperated to the operated position causes said side tabs of the anchoring member to be separated from the remainder of the housing.

8. The modular plug of claim 2, wherein said opening in which said anchoring member is disposed is a first opening and wherein said plug also includes a conductor-restraining bar formed integrally with the housing and disposed within a second opening in the housing interposed between the anchoring member and the terminal-receiving slots and which communicates with the cavity, the restraining bar having a front wall disposed toward said free end of said housing which has a length that as measured in a direction between sidewalls of said housing is substantially less than a length of a rear wall disposed toward the cordage-input end of the housing to cause said bar as viewed from the terminal-receiving side of the plug to which said first and second openings communicate to have a trapezoidal configuration, said restraining bar being separated partially from the remainder of the housing by a first slot oriented toward the cordage-input end of the housing and a second slot, the slots extending substantially equal distances from the second opening toward the cavity, the application of forces to the bar causing the bar to be reformed and upset into the cavity into engagement with conductors in the cavity and causing the bar to be moved toward and into engagement with the conductors with substantially linear displacement of the bar to lock the bar in engagement with conductors of the cordage.

9. The modular plug of claim 2, wherein the housing includes a plurality of conductor-receiving openings and is adapted to receive a plurality of conductors, the conductor-receiving chamber including a plurality of partitions which define parallel conductor-receiving troughs and which extend from a floor surface of the chamber to the surface to which the terminal-receiving openings open, the terminal-receiving openings overlying and extending generally parallel with the troughs, and wherein said housing includes a floor surface which defines said cavity for receiving and end portion of a length of cordage, the floor surface which defines said conductor-receiving chamber and a surface which connects said floor surfaces and which is inclined in a direction from said cordage-input end to a free end of said housing toward said terminal-receiving side of said housing.

10. A device which is used to terminate a jacketed end portion of a length of cordage, said device including:

a housing which is made of a dielectric material, which includes a cavity for receiving an end portion of a jacketed length of cordage which is capable of carrying communications signals and a portion which communicates with said cavity and which receives transmission media extending from the jacketed end portion, which includes a plurality of slots each adapted to receive a terminal that engages an aligned conductor of the end portion of the cordage and which includes an opening disposed toward a cordage-input end thereof; and an anchoring member disposed in said opening of said housing and capable of being moved pivotally from an unoperated position to an operated position wherein it engages the jacketed end portion of the cordage to hold the cordage in secured engagement with said housing, said anchoring member including a jacket-engaging surface which in an unoperated position is angled to a longitudinal axis of the end portion of the cordage and which has suitable length so that when in an operated position in which said jacket-engaging surface is substantially parallel to the longitudinal axis of the end portion of the length of cordage and relative motion between the housing and portions of the cordage adjacent to the end portion of the cordage is caused to occur, undue stress concentration in the cordage are inhibited.

11. A device which is used to terminate a jacketed end portion of a length of cordage, said device including:

a housing which is made of a dielectric material, which includes a cavity for receiving an end portion of a length of jacketed cordage, which includes a conductor-receiving chamber and which includes a plurality of terminal-receiving slots, each said terminal-receiving slot communicating with said conductor-receiving chamber and with an exterior of said housing, further said housing including an opening that is disposed adjacent to a cordage-input end of said housing and that opens to a terminal-receiving side of said housing; and a jacket engaging, cordage anchoring member which is disposed within said opening of said housing, said anchoring member having one portion thereof connected to a portion of the housing to permit pivotal movement of said anchoring member when forces are applied thereto at a location adjacent to the cordage-input end of the housing, said anchoring member including two intersecting surfaces which form a step such that when the anchoring member is moved to an operated position in clamped engagement with an end portion of a length of jacketed cordage which has been inserted into said cordage-input end of said housing, one of said intersecting surfaces engages an inwardly facing surface of the cordage-input end of said housing and the other intersecting surface engaging a wall which defines said opening, the dual engagement of the intersecting surfaces with surfaces of the housing being effective to maintain the anchoring member in locked engagement with the cordage notwithstanding the application of retrograde forces to the cordage, said anchoring member also having a jacket-engaging surface which in an unoperated position is angled to a longitudinal axis of the end portion of the cordage and which has suitable length so that when said anchoring member is in an operated position in which the jacket-engaging surface is oriented substantially parallel to the longitudinal axis of the end portion of the cordage in clamped engagement with the end portion of the jacketed length of cordage and relative motion between the housing and portions of the cordage adjacent to the end portion is caused to occur, undue stress concentrations in the cordage are inhibited.

12. The device of claim 11, wherein said anchoring member includes an inner surface which faces into said cavity when said anchoring member is in an unoperated position such that said inner surface is substantially parallel to the longitudinal axis of said housing and said jacket engaging surface is angled to said inner surface.

13. The device of claim 11, wherein said jacket-engaging surface is a primary jacket anchoring surface and said anchoring member includes a surface which connects said primary jacket-engaging surface to one of said intersecting surfaces, the operation of said anchoring member to cause said intersecting surfaces which form a step to become disposed in locked engagement with said surface of said opening and said surface of said housing causing at least portions of said connecting surfaces and of said inner surface of said anchoring member and said primary jacket-engaging surface to engage the jacket of an end portion of a jacketed length of cordage which has been inserted into said cavity.

14. The device of claim 13, wherein said anchoring member is supported in an unoperated position by means which do not become embedded in the cordage jacket when said anchoring member is moved to an operated position.

15. The device of claim 12, wherein the pivotally moveable portion of the housing includes an anchoring member connected at one end through a hinged portion oriented toward a free end of the housing and the other end of the anchoring member oriented toward the cordage-input end of the housing, said anchoring member being held in the unoperated position by side tabs disposed along at least one axis which is normal to an axis of said plug which extends from said free end to said cordage-input end of said housing so that the application of forces for moving the anchoring member from the unoperated to the operated position causes said side tabs of the anchoring member to be separated from the remainder of the housing.

16. The device of claim 15, wherein said opening in which said anchoring member is disposed is a first opening and wherein said plug also includes a conductor-restraining bar formed integrally with the housing and disposed within a second opening in the housing which is interposed between the anchoring member and the terminal-receiving slots and which communicates with the cavity, the restraining bar having a front wall disposed toward said free end of said housing which has a length that as measured in a direction between sidewalls of said housing which is substantially less than a length of a rear wall disposed toward the cordage input end of the housing to cause said bar as viewed from the terminal-receiving side of the housing to which said first and second openings communicate to have a trapezoidal configuration, said restraining bar being separated partially from the remainder of the housing by a first slot oriented toward the cordage-input end of the housing and a second slot, the slots extending substantially equal distances from the second opening toward the cavity, the application of forces to the bar causing the bar to be reformed and upset into the cavity into engagement with conductors in the cavity and causing the bar to be moved toward and into engagement with conductors with substantially linear displacement of the bar to lock the bar in engagement with conductors of the cordage.

17. A terminated length of jacketed cordage, which comprises:

a length of cordage which includes a plurality of conductors that are capable of carrying electrical signals and a jacket that encloses said plurality of conductors; and a device for terminating the length of cordage, said device comprising:

a housing which is made of a dielectric material, which includes a cavity in which is disposed an end portion of the jacketed length of cordage and a portion which communicates with said cavity and which receives conductors extending from said jacketed end portion, which includes a plurality of slots in each of which is disposed a terminal that engages an aligned conductor of the end portion of the cordage and which includes an opening disposed toward a cordage-input end thereof; and an anchoring member disposed in said opening of said housing and having been moved pivotally from an unoperated position to an operated position wherein it engages the jacketed end portion of the cordage to hold the cordage in secured engagement with said housing, said anchoring member including a jacket-engaging surface which in the unoperated position is angled to a longitudinal axis of the end portion of the cordage and which has suitable length so that when in the operated position in which said jacket-engaging surface is substantially parallel to the longitudinal axis of the end portion of the length of cordage, and relative motion between the housing and portions of the cordage adjacent to the end portion of the cordage is caused to occur, undue stress concentrations in the cordage are inhibited.

18. The terminated length of cordage of claim 17, wherein said anchoring member has one portion thereof connected to a portion of the housing to permit pivotal movement of said anchoring member when forces are applied thereto at a location adjacent to the cordage-input end of the housing, said anchoring member including two intersecting surfaces which form a step such that when the anchoring member is in the operated position in clamped engagement with an end portion of a length of jacketed cordage that has been inserted into said cordage-input end of said housing, one of said intersecting surfaces engages an inwardly facing surface of the cordage-input end of said housing and the other intersecting surface engaging a wall which defines said opening, the dual engagement of the intersecting surfaces with surfaces of the housing being effective to maintain the anchoring member in locked engagement with the cordage notwithstanding the application of retrograde forces to the cordage.

19. The terminated length of cordage of claim 18, wherein said anchoring member includes an inner surface which faces into said cavity when said anchoring member is in an unoperated position such that said inner surface is substantially parallel to the longitudinal axis of said plug and said jacket-engaging surface is angled to said inner surface.

20. The terminated length of cordage of claim 17, wherein the pivotally moveable portion of the housing includes an anchoring member connected at one end through a hinged portion oriented toward a free end of the housing and the other end of the anchoring member oriented toward a cordage-input end of the housing, said anchoring member being held in the unoperated position by side tabs disposed along at least one axis which is normal to an axis of said plug which extends from said free end to said cordage-input end of said housing so that the application of forces for moving the anchoring member from the unoperated to the operated position causes said side tabs of the anchoring member to be separated from the remainder of the housing.

21. The terminated length of cordage of claim 20, wherein said opening in which said anchoring member is disposed is a first opening and wherein said plug also includes a conductor-restraining bar formed integrally with the housing and disposed within a second opening in the housing which is interposed between the anchoring member and the terminal-receiving slots and which communicates with the cavity, the restraining bar having a front wall disposed toward said free end of said housing which has a length that as measured in a direction between sidewalls of said housing is substantially less than a length of a rear wall disposed toward the cordage-input end of the housing to cause said bar as viewed from a top surface of the plug to which said first and second openings communicate to have a trapezoidal configuration, said restraining bar being separated partially from the reminder of the housing by a first slot oriented toward the cordage-input end of the housing and a second slot, the slots extending substantially equal distances from the second opening toward the cavity, the application of forces to the bar causing the bar to be reformed and upset into the cavity into engagement with the conductors in the cavity and causing the bar to be moved toward and into engagement with the conductors with substantially linear displacement of the bar to lock the bar in engagement with conductors of the cordage.

* * * * *